United States Patent [19]

Yoneyama et al.

[11] 4,385,110

[45] May 24, 1983

[54] PROCESS FOR PREPARING COLOR PHOTOGRAPHIC LIGHT-SENSITIVE MATERIALS

[75] Inventors: Maskazu Yoneyama; Takeshi Mikami; Nobuo Tsuji, all of Minami-ashigara, Japan

[73] Assignee: Fuji Photo Film Co., Ltd., Kanagawa, Japan

[21] Appl. No.: 296,097

[22] Filed: Aug. 26, 1981

Related U.S. Application Data

[63] Continuation of Ser. No. 124,048, Feb. 25, 1980, abandoned, which is a continuation of Ser. No. 682,874, May 3, 1976, abandoned.

[30] Foreign Application Priority Data

May 2, 1975 [JP] Japan ..... 50/53483

[51] Int. Cl.[3] ..... G03C 1/40

[52] U.S. Cl. ..... 430/372; 430/377; 430/382; 430/449; 430/512; 430/546; 430/636

[58] Field of Search ..... 430/449, 546, 377, 636, 430/372, 382, 512

[56] References Cited

U.S. PATENT DOCUMENTS

| | | | |
|---|---|---|---|
| 3,551,157 | 12/1970 | Salminen | 430/546 |
| 3,666,478 | 5/1972 | Groh et al. | 430/636 |
| 3,754,924 | 8/1973 | De Geest et al. | 430/636 |
| 3,884,699 | 5/1975 | Cavallo et al. | 430/527 |
| 3,912,517 | 10/1975 | Van Poucke et al. | 430/546 |

*Primary Examiner*—J. Travis Brown

*Attorney, Agent, or Firm*—Sughrue, Mion, Zinn, Macpeak & Seas

[57] ABSTRACT

A process for preparing a color photographic light-sensitive material, which comprises incorporating at least one oil soluble photographic additive into a hydrophilic colloid aqueous solution by dispersing in the presence of an anionic surface active agent having one or more hydrocarbon chain(s), at least one of which is a hydrophobic hydrocarbon chain of 4 to 18 carbon atoms wherein the hydrogen atoms of one or more of the hydrocarbon chain(s) are wholly or partly substituted with fluorine, and having 1 to 3 $-SO_3M$ or $OSO_3M$ groups (M being a hydrogen atom or a cation) as an anionic moiety.

7 Claims, No Drawings

PROCESS FOR PREPARING COLOR PHOTOGRAPHIC LIGHT-SENSITIVE MATERIALS

This application is a continuation application of Ser. No. 124,048, filed Feb. 25, 1980, now abandoned, in turn a continuation application of Ser. No. 682,874, filed May 3, 1976, now abandoned.

BACKGROUND OF THE INVENTION

1. Field of the Invention

This invention relates to a process for preparing color photographic light-sensitive materials.

2. Description of the Prior Art

Various compounds are known as a light-sensitive ingredient for color photographic light-sensitive materials. Of these, silver halide is commonly used. Silver halide color photographic light-sensitive materials commonly comprise a support having provided thereon a red-sensitive silver halide emulsion, a green-sensitive silver halide emulsion and a blue-sensitive silver halide emulsion, and possess various forms. There are known many techniques including, for example, a mixed grain process, a multi-layered light-sensitive material, a color diffusion transfer process, a silver-dye bleaching color photographic process, etc.

In the color photographic art, as photographic additives used for such silver halide color photographic light-sensitive materials, those of the type which are oil soluble to improve some properties, and are used by dissolving them in a substantially water insoluble, high boiling point solvent (e.g., a high boiling point organic solvent) and dispersing in a hydrophilic colloid aqueous solution (usually using an anionic surface active agent as an emulsifying agent) have recently come into wide use.

There are many such oil soluble photographic additives such as oil soluble couplers, oil soluble ultraviolet ray absorbing agents, oil soluble anti-fading agents, oil soluble color mixing preventing agents, oil soluble stain preventing agents, oil soluble anti-oxidants, etc.

As processes for emulsifying and dispersing these oil soluble photographic additives, there are known, for example, the following: U.S. Pat. Nos. 2,739,888, 3,352,681, etc., give descriptions as to ultraviolet ray absorbing agents, and U.S. Pat. Nos. 2,360,290, 2,728,659 3,700,453; etc., describe diffusion resistant alkylhydroquinones for use in preventing color fogging, color stain, color mixing, and the like. In particular, a process of emulsifying and dispersing oil soluble photographic additives using an anionic surface active agent as an emulsifying agent is known. For example, U.S. Pat. No. 2,332,027 describes a process using Gardinol WA (trade name of sulfonated cocoanut fatty alcohol, manufactured by E. I. Du Pont de Nemours and Co.) and triisopropylnaphthalenesulfonic acid salt, Japanese Pat. No. 428,191 describes a process using a water soluble coupler having a sulfonic group or carboxyl group and a long chain aliphatic group in combination as an emulsifying agent, and U.S. Pat. No. 3,676,141 describes a process using an anionic surface active agent having a sulfo group and an anhydrohexylester type nonionic surface active agent in combination. However, these emulsifying and dispersing processes provide dispersed particles of a coarse size (more than about 2$\mu$) and fail to provide fine particles (less than about 0.5$\mu$) required in recent photographic materials. In particular, the photographic element of a color photographic light-sensitive material coated on a support is designed to be thick, and, hence, when an emulsion dispersion to be added thereto contains coarse particles, light transmitting through the photographic element is scattered, which exerts a detrimental influence on photographic properties, making the element opaque. Also, it can be a factor in deteriorating image properties such as image sharpness and graininess.

On the other hand, decreasing the size of, in particular, a coupler emulsion dispersion increases the surface area of the particles per unit weight, which serves to increase coloring velocity, coloring efficiency, the covering power of formed dye images, and image density. However, in order to make the particle size of an emulsion dispersion finer, it is usually necessary to use an emulsifying agent in a large amount. The use of an emulsifying agent in a large amount is liable to cause coating troubles due to foaming of the emulsion, such as the formation of pinholes, uneveness in the coated film thickness, etc., and to deteriorate the film quality of the coated photographic element of a light-sensitive material (for example, the adhesiveness or the stickiness of the coated film becomes so large at high temperature and under high humidity that adhesion troubles between photographic light-sensitive materials or between photographic light-sensitive materials and a camera often result). Further, it inhibits the antistatic ability of an antistatic agent used in combination therewith. Still further, reducing the size of dispersed particles in an emulsion dispersion usually leads to agglomeration of the particles, destruction of the emulsion, etc., with the passage of time.

Thus, conventionally used surface active agents as described above fail to provide an adequate reduction in the particle size of an emulsion dispersion or entail some defects.

SUMMARY OF THE INVENTION

One object of the present invention is to provide a process for finely dispersing oil soluble photographic additives (e.g., oil soluble couplers, oil soluble ultraviolet ray absorbing agents, etc.) in a hydrophilic colloid aqueous solution.

Another object of the present invention is to provide a silver halide color photographic light-sensitive material which enables one to produce a silver halide color photographic light-sensitive material with ease, and which can be stored in a stable fashion over a long period of time and which shows high coloring ability.

A further object of the present invention is to provide a photographic light-sensitive material showing no secondary detrimental effects and having improved surface film quality.

Still a further object of the present invention is to provide a color photographic light-sensitive material having no other defects as described above.

These and other objects of the present invention will become apparent from the following description.

The above described objects of the present invention have been attained by the following process, that is, by a dispersing process which comprises dispersing oil soluble photographic additives in a hydrophilic colloid aqueous solution in the presence of an anionic surface active agent having chain(s), at least one of which is a hydrophobic hydrocarbon chain of 4 to 18 carbon atoms, wherein the hydrogen atoms of one or more of the hydrocarbon chain(s) are wholly or partly substituted with fluorine, and having 1 to 3 —SO,M or —O-

$SO_3M$ groups (M being a hydrogen atom or a cation) as an anionic moiety, or by a process for preparing a color photographic light-sensitive material having incorporated therein oil soluble photographic additives according to the above described process.

DETAILED DESCRIPTION OF THE INVENTION

Preferred examples of the above described anionic surface active agents of the present invention are represented by the following general formula:

$$(R_f)_n(B)_m—X \quad (I)$$

wherein $R_f$ represents a fluorine substituted alkyl or alkenyl group having 4 to 18 carbon atoms, with fluorinated hydrocarbon groups having 8 or more fluorine atoms and containing a terminal carbon atom substituted with two or three fluorine atoms being preferred, X represents an $—SO_3M$ or $—OSO_3M$ group (M being a hydrogen atom or a cation), B represents a di- or trivalent organic residue represented by $$—R_1— \quad \text{or} \quad —\underset{|}{R_2}—,$$

preferably such a group having 1 to 30 carbon atoms (for example, a di- or a trivalent aliphatic hydrocarbon group wherein a methylene group may be partly replaced by an oxa group, preferably up to 15 oxa groups, an arylene group (e.g., a phenylene group, 1,4-naphthylene group, 2-hydroxy-1,4naphthylene group, tolylene group, etc.), a divalent heterocyclic ring, preferably a 5- or 6-membered hetero ring containing N, O or S, which can have a fused ring of the benzene series, e.g., benzene, if desired (e.g., divalent benzimidazole group, 1-alkylbenzimidazole-2-yl group, etc.)), or a multivalent group wherein a di- or trivalent organic residue (preferably such a group having 1 to 30 carbon atoms) is combined with a divalent linkage group (e.g., —CO—O—, —O—CO—, —NR—CO—, —CO—NR—, $—SO_2NR—$, etc., R being a hydrogen atom or an alkyl group having 1 to 18 carbon atoms) (for example, $$(—SO_2—\underset{\underset{R}{|}}{M}—R_1—O—CO)_2R_2—,$$

$—COOR_1—$, $—R_1O—CO—R_1—$, $—CONH—R_1—$ and $—SO_2NR—R_1—$ (where $R_1$, $R_2$ and R are the same as defined above), etc.), n represents 1 or 2, and m represents 0 or 1.

Preferred cations as M include an alkali metal such as lithium, sodium and potassium, an ammonium or an organic ammonium group such as diethanolammonium, triethanolammonium, trimethylammonium, triethylammonium, morpholinium, pyridinium, etc.

Specific examples of $R_f$ include 1,1,7-trihydrododecafluoroheptyl, 1,1,11-trihydroeicosafluoroundecyl, perfluorooctyl, 1,1-dihydropentadecylfluorooctyl, perfluoro-3-ethyl-1,2,3-trimethyl-1-pentenyl, etc.

Several particularly useful specific examples of the above described anionic surface active agents of the present invention are shown below.

$$CF_3(CF_2)_7SO_2\underset{\underset{C_3H_7}{|}}{N}CH_2CH_2CH_2SO_3Na \quad \text{(A-1)}$$

$$CF_3(CF_2)_7SO_2\underset{\underset{C_2H_5}{|}}{N}(CH_2)_4SO_3K \quad \text{(A-2)}$$

$$H(CF_2)_6CH_2O(CH_2)_3SO_3Na \quad \text{(A-3)}$$

$$H(CF_2)_6CH_2O(CH_2)_3SO_3Na \quad \text{(A-4)}$$

$$H(CF_2)_{10}CH_2O(CH_2)_3SO_3H.N(CH_2)_3 \quad \text{(A-5)}$$

$$CF_3(CF_2)_7SO_2\underset{\underset{C_3H_7}{|}}{N}CH_2CH_2O(CH_2CH_2O)_n(CH_2)_3SO_3Na \quad n = 1 \quad \text{(A-6)}$$

$$CF_3(CF_2)_7SO_2\underset{\underset{C_3H_7}{|}}{N}CH_2CH_2O(CH_2CH_2O)_n(CH_2)_3SO_3Na \quad n = 3 \quad \text{(A-7)}$$

$$CF_3(CF_2)_7SO_2\underset{\underset{C_3H_7}{|}}{N}CH_2CH_2O(CH_2CH_2O)_n(CH_2)_3SO_3Na \quad n = 5 \quad \text{(A-8)}$$

$$CF_3(CF_2)_7SO_2\underset{\underset{C_3H_7}{|}}{N}CH_2CH_2O(CH_2CH_2O)_n(CH_2)_3SO_3Na \quad n = 10 \quad \text{(A-9)}$$

$$CF_3(CF_2)_6CONHCH_2CH_2O(CH_2)_3SO_3Na \quad \text{(A-10)}$$

$$H(CF_2)_6CO\underset{\underset{CH_3}{|}}{N}(CH_2)_3SO_3Na \quad \text{(A-11)}$$

$$\begin{array}{l} CH_2COOCH_2(CF_2)_6N \\ | \\ CHCOOCH_2(CF_2)_6H \\ | \\ SO_3Na \end{array} \quad \text{(A-12)}$$

$$\begin{array}{l} CH_2COOCH_3(CF_2)_6CF_3 \\ | \\ CHCOOCH_2(CF_2)_6CF_3 \\ | \\ SO_3Na \end{array} \quad \text{(A-13)}$$

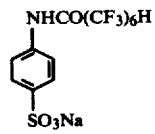

(A-14)

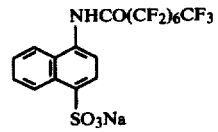

(A-15)

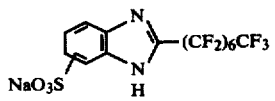

(A-16)

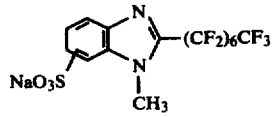

(A-17)

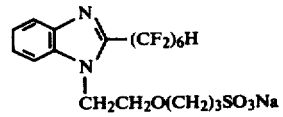

(A-18)

-continued (A-19)

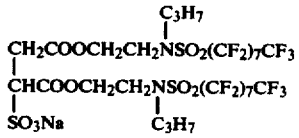

(A-20)

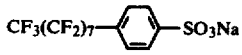

(A-21) $CF_3(CF_2)_7SO_3K$ (A-22) $CF_3(CF_2)_{11}CH_2OSO_3Na$ (A-23) $CF_3(CF_2)_6COO(CH_2)_3SO_3Na$ (A-24)

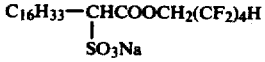

(A-25)

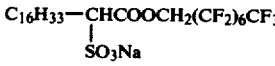

(A-26)

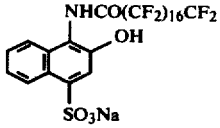

(A-27)

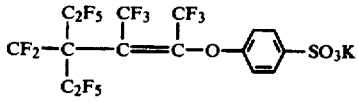

(A-28)

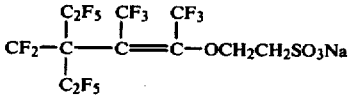

(A-29)

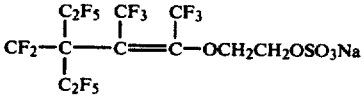

These compounds used in the present invention can be synthesized according to the processes described in, e.g., U.S. Pat. Nos. 2,559,715; 2,567,011; 2,732,398; 2,764,602; 2,806,866; 2,809,998; 2,915,376; 2,915,528; 2,934,450; 2,937,098; 2,957,031; 3,472,894; 3,555,089; Japanese Patent Publication No. 37,304/70, Japanese Patent Application (OPI) No. 9,613/72, *J. Chem. Soc.*, p. 2,789 (1950), ibid., pp. 2,574 and 2,640 (1957), *J. Amer. Chem. Soc.*, 79, p. 2,549 (1957), and *J. Japan Oil Chemist's Soc.*, 12, p. 653.

Some of these fluorocarbon compounds used in the present invention are sold by Dai Nippon Ink & Chemicals, Inc., under the trade name Megafac F (for example, F-109, F-110, F-115) and by Imperial Chem. Ind. Ltd., under the trade name Monflor (for example, Monflor 31).

The fluorocarbon containing anion surface active agent to be used in the present invention can be added to either an oil soluble photographic additive (e.g., couplers, etc.) solution or a colloid aqueous solution, or to both, within the allowable range of solubility.

As the oil soluble photographic additives to which the present invention is applicable, there can be illustrated many compounds such as oil soluble couplers, DIR coupling compounds forming no color, ultraviolet ray absorbing agents, fading preventing agents, color mixing preventing agents, stain preventing agents, antioxidants, and the like.

Examples of couplers to which the present invention is applicable are described in, for example, the following patents.

As yellow couplers, open chain diketomethylene compounds are widely used. Examples thereof are described in, e.g., U.S. Pat. Nos. 3,341,331; 2,875,057; 3,551,155; West German Patent (OLS) No. 1,547,868; U.S. Pat. Nos. 3,265,506; 3,582,322; 3,725,072; West German Patent (OLS) No. 2,162,899; U.S. Pat. Nos. 3,369,895; 3,408,194; West German Patent (OLS) Nos. 2,057,941; 2,213,461; 2,219,917; 2,261,361; 2,263,873; etc.

As magenta couplers, 5-pyrazolone compounds are mainly used, with indazolone compounds and cyanoacetyl compounds also being used. Examples thereof are described in, e.g., U.S. Pat. Nos. 2,439,098; 2,600,788; 3,062,653; 3,558,319; British Pat. No. 956,261; U.S. Pat. Nos. 3,582,322; 3,615,506; 3,519,429; 3,311,476; 3,419,391; Japanese Patent Application Nos. 21,454/73; 56,050/73, West German Pat. No. 1,810,464; Japanese Patent Publication No. 2,016/69; Japanese Patent Application No. 45,971/73; U.S. Pat. No. 2,983,608; etc.

As cyan couplers, phenol or naphthol derivatives are mainly used. Examples thereof are described in, e.g., U.S. Pat. Nos. 2,369,929; 2,474,293; 2,698,794; 2,895,826; 3,311,476; 3,458,315; 3,560,212; 3,582,322; 3,591,383; 2,434,272; 2,706,684; 3,034,892; 3,583,971; West German Patent (OLS) No. 2,163,811; Japanese Patent Publication No. 28,836/70; Japanese Patent Application No. 33,238/73; etc.

In addition, couplers capable of releasing a development inhibitor upon color reaction (DIR couplers) or compounds capable of releasing a development inhibitor may be added. Examples thereof are described in U.S. Pat. Nos. 3,418,062; 3,227,554; 3,253,924; 3,617,291; 3,622,328; 3,705,201; British Pat. No. 1,201,110; U.S. Pat. Nos. 3,297,445; 3,379,529; 3,639,417; etc.

Two or more of the above described couplers can simultaneously be emulsified and dispersed in order to incorporate two or more of them in the same layer for obtaining photographic properties required for a light-sensitive material. Several specific examples are illustrated below.

Yellow-forming couplers (Y-1)

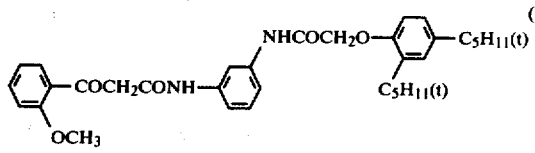

(Y-2)

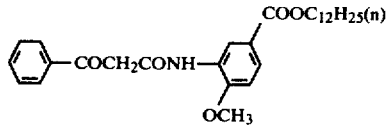

(Y-3)

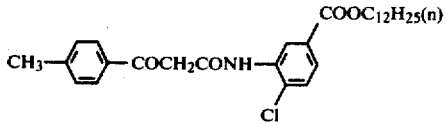

-continued
Yellow-forming couplers
(Y-4)
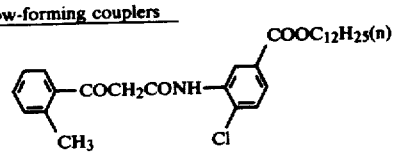
(Y-5)
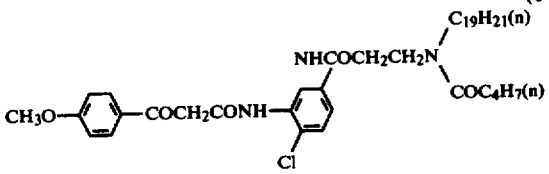
(Y-6)
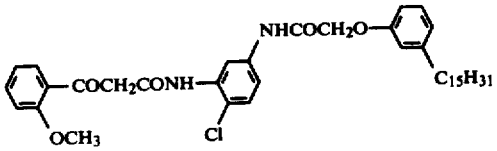
-continued
(C-2)
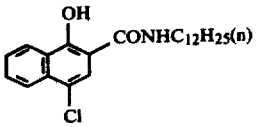
(C-3)
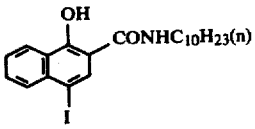
(C-4)
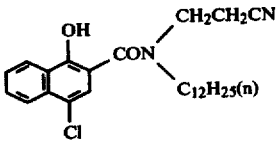
(C-5)
Magenta-forming couplers
(M-1)
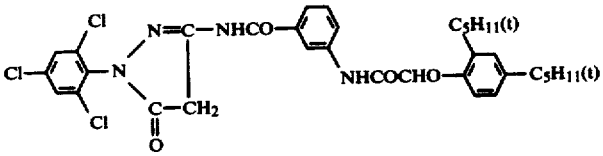
(M-2)
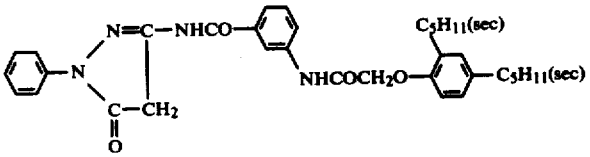
(M-3)
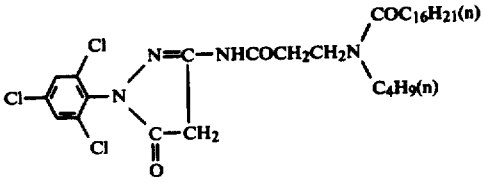
(M-4)
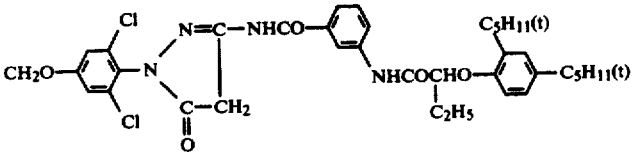
(M-5)
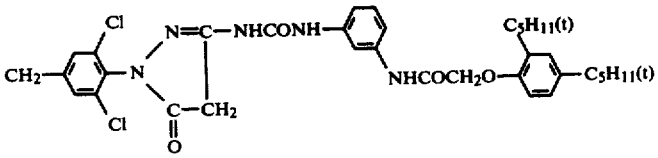
Cyan-forming couplers
(C-1)
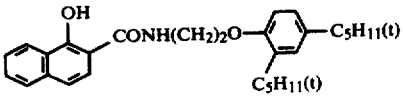
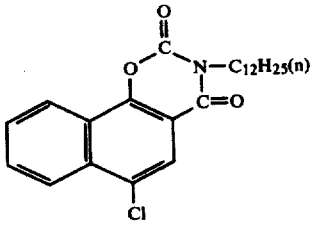

-continued
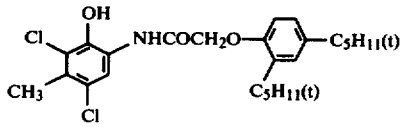
(C-6)
DIR couplers (development inhibitor releasing couplers)
Mask-forming colored couplers
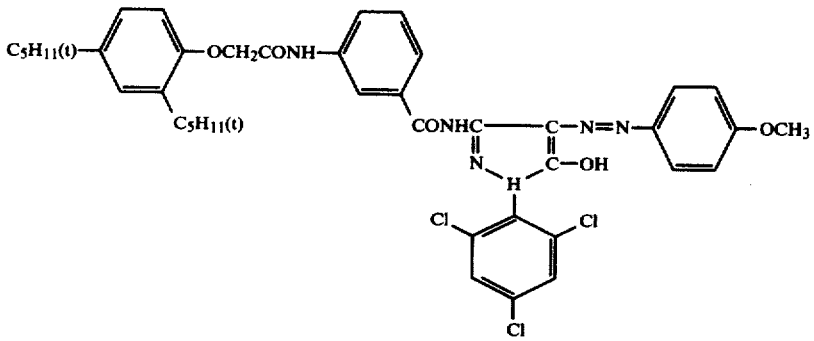
(L-1)
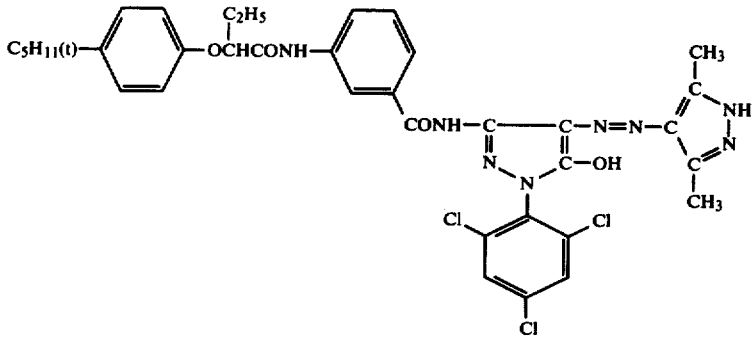
(L-2)
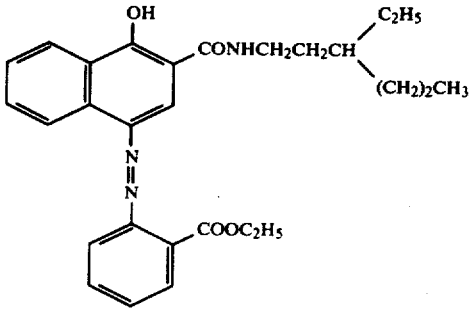
(L-3)
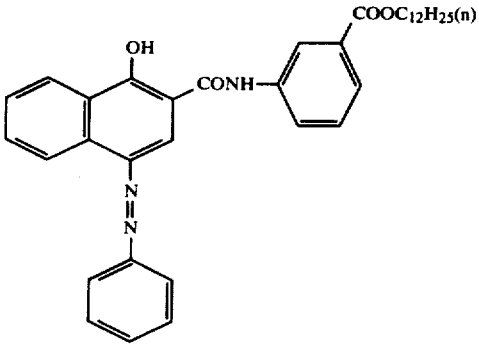
(L-4)

-continued (N-1)

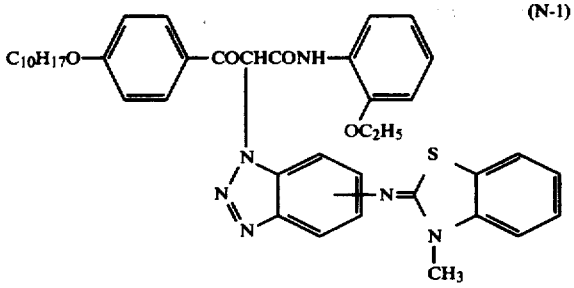

(N-2)

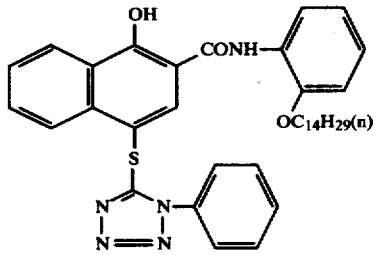

(N-3)

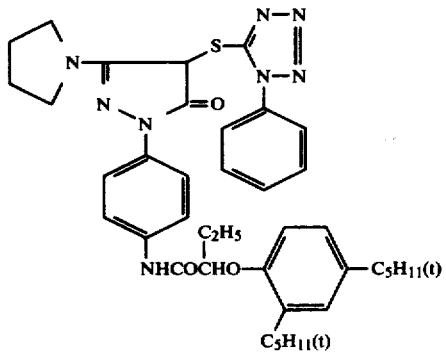

Oil soluble ultraviolet ray absorbing agents suitable for the practice of the present invention are described in, e.g., Japanese Patent Publication Nos. 21,687/67; 5,496/73; British Pat. No. 2,293,982; etc. Several specific examples of ultraviolet ray absorbing agents suitable for the practice of the present invention are as follows.

(U-1)

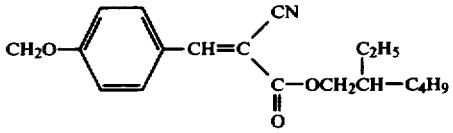

(U-2)

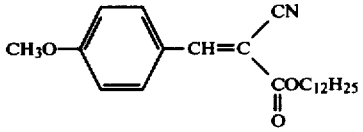

(U-3)

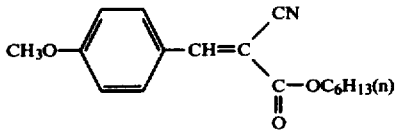

-continued (U-4)

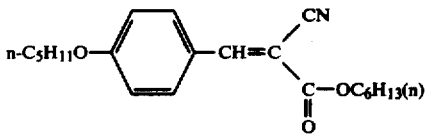

(U-5)

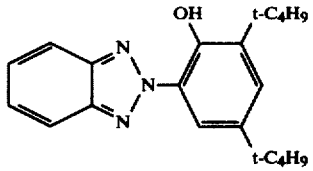

(U-6)

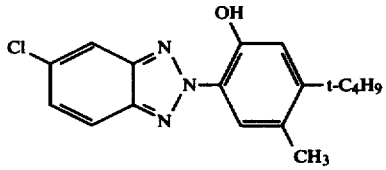

(U-7)

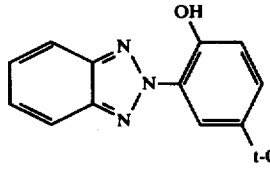

Oil soluble antioxidants suitable for the practice of the present invention include the compounds described in, e.g., U.S. Pat. Nos. 2,336,327; 2,728,659; 2,835,579; and Japanese Patent Application (OPI) No. 2,128/71.

Anti-fading agents for colored dye images suitable for the practice of the present invention are the compounds described in, e.g., Belgian Pat. No. 777,487; German Pat. No. 1,547,684; German Patent (OLS) No. 2,146,668; etc.

In the present invention, oil soluble photographic additives must be in a liquid state before emulsifying, e.g., by melting them with heat or dissolving in an organic solvent. Those which can be directly emulsified by melting are limited to compounds having a melting point of not more than about 90° C.

As the solvent (i.e., the oil ingredient) to be used for finely dispersing oil soluble photographic additives in an aqueous medium, those which are substantially water insoluble and which have a boiling point of not less than about 190° C. at ordinary pressure are useful. This type of organic solvent can be selected from among carboxylic acid esters, phosphoric acid esters, carboxylic acid amides, ethers and substituted hydrocarbons. As specific examples thereof, there are illustrated di-n-butyl phthalate, di-isooctyl phthalate, dimethoxyethyl phthalate, di-n-butyl adipate, diisooctyl azelate, tri-n-butyl citrate, butyl laurate, di-n-sebacate, tricresyl phosphate, tri-n-butyl phosphate, triisooctyl phosphate, N,N-diethylcaprylamide, N,N-dimethylpalmitic amide, n-butyl-m-pentadecylphenyl ether, ethyl-2,4-tert-butylphenyl ether, chlorinated paraffins, etc.

In the present invention, it is, in some cases, advantageous to use a low boiling point solvent or a water soluble, high boiling point solvent in addition to the above described solvents for dissolving oil soluble photographic additives. Such solvents include, for example, propylene carbonate, ethyl acetate, butyl acetate, ethyl propionate, sec-butyl alcohol, tetrahydrofuran, cyclohexanone, dimethylformamide, diethylsulfoxide, methyl cellosolve, etc.

As the emulsifying apparatus for use in practicing the present invention, those which apply a high shearing force to a processing solution or which provide ultrasonic wave energy of high strength are suitable. In particular, a colloid mill, a homogenizer, a capillary tube emulsifying apparatus, an electromagnetic strain ultrasonic wave generator, and an emulsifying apparatus with a Pohleman whistle can provide favorable results.

The amount of the anionic surface active agent used in the practice of the present invention varies depending upon the kind of oil soluble photographic additives used (e.g., couplers, ultraviolet ray absorbing agents, antioxidants, etc.), the kind and the amount of the solvent for the dispersing, and the kind of color light-sensitive materials. In general, however, it is about 0.5 to about 50% by weight based on the dispersion weight, more preferably 0.5 to 10%, same basis (i.e., a solution prepared by dissolving oil soluble photographic additives in a solvent for dispersion).

The effects and advantages of the present invention are described below.

The present invention enables one to finely emulsify and disperse photographic additives in a stable manner, e.g., oleophilic couplers, oleophilic ultraviolet ray absorbing agents, oleophilic antioxidants, etc., without harming photographic properties and without any problems in coating, thereby providing photographic light-sensitive materials having improved properties, in particular, improved adhesion resistance of the surface films.

The fluorocarbon surface active agents used in the present invention have the property of greatly reducing interfacial tension between an oil phase/aqueous phase as compared with ordinary surface active agents. Therefore, they may be used in a small amount as an emulsifier. Emulsifying agents conventionally used in the photographic field are generally hygroscopic and have a tendency to deteriorate the quality of the surface of light-sensitive materials. Therefore, when they are used in a large amount, the surface becomes adhesive. Also, in coating, in particular in multi-layer coating, it becomes difficult to apply an upper layer. Further, they inhibit the action of any antistatic agent used. The present invention has successfully removed these difficulties.

As the support for the photographic light-sensitive material of the present invention, all of those which can be used as a support for ordinary photographic light-sensitive materials can be used. For example, there are a cellulose nitrate film, a cellulose acetate film, a cellulose acetate butyrate film, a cellulose acetate propionate film, a polystyrene film, a polyethylene terephthalate film, a polycarbonate film, layered products thereof, paper, etc. Papers coated or laminated with baryta or an α-olefin polymer, in particular, a polymer of an α-olefin having 2 to 10 carbon atoms such as polyethylene, polypropylene, etc., plastic films whose surface has been roughened to improve adhesive properties to other polymer substance as described in Japanese Patent Publication No. 19,068/72, and like supports are also preferred.

Various conventional hydrophilic colloids can be used in the light-sensitive material of the present invention. As the hydrophilic colloid used as a binder for photographic emulsions and/or other photographic material layers, there can be illustrated, e.g., gelatin, colloidal albumin, casein, cellulose derivatives (e.g., carboxymethyl cellulose, hydroxyethyl cellulose, etc.), sugar derivatives (e.g., agar-agar, sodium alginate, starch derivatives, etc.), synthetic hydrophilic colloids (e.g., polyvinyl alcohol, poly-N-vinyl pyrrolidone, polyacrylic acid copolymers, polyacrylamide, the derivatives or partially hydrolyzed products thereof, etc.). If desired or necessary, a compatible mixture of two or more of these colloids can be used.

Of these, the most generally used is gelatin. Gelatin can be replaced, partly or wholly, by a synthetic high molecular weight substance as set out above, by a gelatin derivative (prepared by processing and modifying gelatin with a reagent having a group capable of reacting with the functional groups contained in a gelatin molecule (i.e., amino groups, imino groups, hydroxy groups or carboxy groups)), or by a graft polymer prepared by grafting a molecular chain of another high molecular weight substance onto gelatin.

As the reagent for preparing the above described gelatin derivatives, there are illustrated, e.g., isocyanates, acid chlorides and acid anhydrides as described in U.S. Pat. No. 2,614,928, acid anhydrides as described in U.S. Pat. No. 3,118,766, bromoacetic acid as described in Japanese Patent Publication No. 5,514/64, phenyl glycidyl ethers as described in Japanese Patent Publication No. 26,845/67, vinyl sulfone compounds as described in U.S. Pat. No. 3,132,945, N-allylvinylsulfonamides as described in British Pat. No. 861,414, maleinimide compounds as described in U.S. Pat. No. 3,186,846, acrylonitriles as described in U.S. Pat. No. 2,594,293, polyalkylene oxides as described in U.S. Pat. No. 3,312,553, epoxy compounds as described in Japanese Patent Publication No. 26,845/67, acid esters as described in U.S. Pat. No. 2,763,639, alkanesultones as described in British Pat. No. 1,033,189, and the like.

As to the branch high molecular polymers grafted onto gelatin, many descriptions are given in U.S. Pat. Nos. 2,763,625; 2,831,767; 2,956,884; *Polymer Letters*, 5, 595 (1967), *Phot. Sci. Eng.*, 9, 148 (1965), *J. Polymer Sci.*, A-1, 9, 3199 (1971), and the like. Homopolymers or copolymers of those which are generally called vinyl monomers, such as acrylic acid, methacrylic acid, ester, amide, or nitrile derivatives thereof, styrene, etc., can widely be used. However, hydrophilic vinyl polymers having some compatibility with gelatin, such as homopolymers or copolymers of acrylic acid, acrylamide, methacrylamide, hydroxyalkyl acrylate, hydroxyalkyl methacrylate, etc., are particularly preferred.

In the photographic emulsion layers and other layers used in the present invention there may be incorporated synthetic polymer compounds such as latex-like vinyl polymers dispersed in water, compounds capable of increasing, in particular, the dimensional stability of photographic materials, and the like, alone or in combination (of different polymers) or in combination with a hydrophilic water permeable colloid. As the polymers, there are many compounds described in, e.g., U.S. Pat. Nos. 2,376,005; 2,739,137; 2,853,457; 3,488,708; 3,525,620; 3,635,715; 3,607,290; 3,645,740; British Pat. Nos. 1,186,699; 1,307,373; etc. Of these, copolymers or homopolymers of monomers selected from among alkyl acrylate, alkyl methacrylate, acrylic acid, methacrylic acid, sulfoalkyl acrylate, sulfoalkyl methacrylate, glycidyl acrylate, glycidyl methacrylate, hydroxyalkyl acrylate, hydroxyalkyl methacrylate, alkoxyalkyl acrylate, alkoxy methacrylate, styrene, butadiene, vinyl chloride, vinylidene chloride, maleic anhydride and itaconic anhydride are generally used. In some cases, graft-type emulsion polymerization latexes prepared by conducting emulsion polymerization in the copresence of a hydrophilic protective colloid high molecular weight polymer may be used.

Hardening of photographic emulsion layers and/or other photographic material layers can be conducted in a conventional manner. As examples of hardeners, there are aldehyde compounds such as formaldehyde, glutaraldehyde, etc.; ketone compounds such as diacetyl, cyclopentanedione, etc.; compounds having a reactive halogen such as bis(2-chloroethylurea), 2-hydroxy-4,6-dichloro-1,3,5-triazine and those described in U.S. Pat. Nos. 3,288,775; 2,732,303; British Pat. Nos. 974,723; 1,167,207; etc.; compounds having a reactive olefin such as divinylsulfone, 5-acetyl-1,3-diacryloylhexahydro-1,3,5-triazine, those described in U.S. Pat. Nos. 3,635,718; 3,232,763; 3,490,911; 3,642,486; British Pat. No. 994,869, etc.; N-methylol compunds such as N-hydroxymethylphthalimide and those shown in U.S. Pat. Nos. 2,732,316; 2,586,168; isocyanates as shown in U.S. Pat. No. 3,103,437; aziridine compunds as shown in U.S. Pat. Nos. 3,017,280; 2,983,611; etc.; acid derivatives as shown in U.S. Pat. Nos. 2,725,294; 2,725,295; etc.; carbodiimide compounds as shown in U.S. Pat. No. 3,100,704, etc.; epoxy compounds as shown in U.S. Pat. No. 3,091,537, etc.; isoxazole compounds as shown in U.S. Pat. Nos. 3,321,313 and 3,543,292, etc.; halogenocarboxyaldehydes such as mucochloric acid, etc.; dioxane derivatives such as dihydroxydioxane, dichlorodioxane, etc.; and inorganic hardening agents such as chromium alum, zirconium sulfate, etc. Also, precursors of the above described compounds such as alkali metal bisulfite-aldehyde adducts, hydantoin methylol compounds, primary aliphatic nitroalcohols, etc., can be used in place of the above described compounds.

Silver halide photographic emulsions are usually prepared by mixing a water soluble silver salt (e.g., silver nitrate) with a water soluble halide (e.g., potassium bromide) in the presence of a solution of water soluble high molecular weight polymer such as gelatin. As the silver halide, there can be used mixed silver halides such as silver chlorobromide, silver bromoiodide, silver chlorobromoiodide, etc., as well as silver chloride and silver bromide. These silver halide grains are formed according to known common processes. Of course, it is useful to prepare them according to a single or double jet process, controlled double jet process, etc.

Also, two or more silver halide photographic emulsions separately prepared may be used by mixing them.

To the above described photographic emulsion there can be added various compounds in order to prevent a reduction in sensitivity and formation of fog in production, storage or during processing of the light-sensitive material. As such compounds, there have long been known many compounds such as many heterocyclic compounds including 4-hydroxy-6-methyl-1,3,3a,7-tetrazaindene, 3-methylbenzothiazole and 1-phenyl-5-mercaptotetrazole, mercury containing compunds, mercapto compounds, metal salts, and the like.

Some examples of usable compounds are described in U.S. Pat. Nos. 1,758,576; 2,110,178; 2,131,038; 2,173,628; 2,697,040; 2,304,962; 2,324,123; 2,394,198; 2,444,605 to 8; 2,566,245; 2,694,716; 2,697,099; 2,708,162; 2,728,663 to 5; 2,476,536; 2,824,001; 2,843,491; 2,886,437; 3,052,544; 3,137,577; 3,220,839; 3,226,231; 3,236,652; 3,251,691; 3,252,799; 3,287,135; 3,326,681; 3,420,668; 3,619,198; 3,622,339; 3,650,759; British Pat. Nos. 893,428; 403,789; 1,173,609; 1,200,188; etc.

The silver halide emulsion can be chemically sensitized in a conventional manner, if desired. As the chemically sensitizing agents, there can be illustrated gold compounds such as chloroauric acid salt and auric chloride as described in U.S. Pat. Nos. 2,399,083; 2,540,085; 2,597,856; and 2,597,915; salts of noble metals such as platinum, palladium, iridium, rhodium, ruthenium, etc., as described in U.S. Pat. Nos. 2,448,060; 2,540,086; 2,566,245; 2,566,263; and 2,598,079; sulfur compounds capable of reacting with a silver salt to form silver sulfide as described in U.S. Pat. Nos. 1,574,944, 2,410,689; 3,189,458; 3,501,313; etc., stannous salts as described in U.S. Pat. Nos. 2,487,850; 2,518,698; 2,521,925; 2,521,926; 2,694,637; 2,983,610; 3,201,254; amines and other reducing substances.

Photographic emulsions may, if desired or necessary, be subjected to spectral sensitization or supersensitization using cyanine dyes such as cyanine, merocyanine, carbocyanine, etc., dyes, alone or in combination, or in further combination with styryl dyes, etc.

Such color sensitizing techniques have long been known and related descriptions are given in, e.g., U.S. Pat. Nos. 2,493,748; 2,519,001; 2,977,229; 3,480,434; 3,672,897; 3,703,377; 2,688,545; 2,912,329; 3,397,060; 3,615,635; and 3,628,964; British Pat. Nos. 1,195,302; 1,242,588; and 1,293,862; West German Patents (OLS) Nos. 2,030,326 and 2,121,780; Japanese Patent Publications Nos. 4,936/68; 14,030/69; and 10,773/68; U.S. Pat. Nos. 3,511,664; 3,522,052; 3,527,641; 3,615,613; 3,615,632; 3,617,295; 3,635,721; and 3,694,217; British Pat. Nos. 1,137,580 and 1,216,203; etc. The technique used can optionally be selected according to the end use of the light-sensitive materials such as the wavelength region to be sensitized, sensitivity and the like.

The photographic light-sensitive material of the present invention can contain in a photographic material layer polyols as described in, e.g., U.S. Pat. Nos. 2,960,404; 3,042,524; 3,520,694; 3,656,956; 3,640,721; etc., as a plasticizer.

The photographic light-sensitive material of the present invention can comprise, if desired, for example, a protective layer, a filter layer, in interlayer, an antihalation layer, a subbing layer, a backing layer, an antistatic layer and a curl balance layer as an ordinary light-insensitive photographic material layer in addition to the silver halide emulsion layer(s).

The photographic light-sensitive material of the present invention can contain in a light-insensitive photographic layer a brightening agent (e.g., stilbene, triazine, oxazole and cumarin compounds), an ultraviolet ray absorbing agent (e.g., benzotriazole, thiazolidine and cinnamic acid ester compounds), a light absorbent (various known photographic filter dyes), water insoluble substances as described in, e.g., British Pat. Nos. 1,320,564; 1,320,565; U.S. Pat. No. 3,121,060; etc., and a surface active substance as described in U.S. Pat. No. 3,617,286. Also, it can contain as a matting agent inorganic compounds of a suitable particle size such as silver halide (preferably about 2 microns in mean grain size), silica, strontium/barium sulfate, etc., a latex of a polymer such as polymethyl methacrylate, etc.

The photographic light-sensitive material of the present invention can contain in the photographic material layers (including photographic emulsion layers), in particular, in an antistatic layer provided as an outermost layer of the photographic light-sensitive material, antistatic agents such as hydrophilic polymers as described in, e.g., U.S. Pat. Nos. 2,725,297; 2,972,535; 2,972,536; 2,972,537; 2,972,538; 3,033,679; 3,072,484; 3,262,807; 3,525,621; 3,615,531; 3,630,743; 3,653,906; 3,655,384; and 3,655,386; and British Pat. Nos. 1,222,154 and 1,235,075; hydrophobic polymers as described in, e.g., U.S. Pat. Nos. 2,973,263 and 2,976,148; biguanide compounds as described in, e.g., U.S. Pat. Nos. 2,584,362 and 2,591,590; sulfonic acid comprising anionic compounds as described in U.S. Pat. Nos. 2,639,234; 2,649,372; 3,201,251; and 3,457,076; phosphoric acid esters and quaternary ammonium salts as described in, e.g., U.S. Pat. Nos. 3,317,344 and 3,514,291; cationic compounds as described in, e.g., U.S. Pat. Nos. 2,882,157; 2,982,651; 3,399,995; 3,549,369; and 3,564,043; nonionic compounds as described in, e.g., U.S. Pat. No. 3,625,695, amphoteric compounds as described in, e.g., U.S. Pat. No. 3,736,268, etc., complex compounds as described in, e.g., U.S. Pat. No. 2,647,836, etc., and organic salts as described in, e.g., U.S. Pat. Nos. 2,717,834; 3,655,387; etc.

The present invention can be applied to all kinds of photographic light-sensitive materials including black-and-white light-sensitive materials and color light-sensitive materials.

The silver halide emulsions processable include various silver halide photographic emulsions such as orthochromatic emulsions, panchromatic emulsions, emulsions for infrared rays, emulsions for recording invisible rays such as X-rays, color photographic emulsions, for example, emulsions containing color forming couplers, dye developer containing emulsions, emulsions containing bleachable dyes, and the like.

Development processing is necessary after imagewise exposure of the color photographic light-sensitive material in order to obtain dye images. Development processing fundamentally involves a color development step, a bleaching step, and a fixing step. Each step may be effected independently, or, two or more steps may be conducted in one processing using a processing solution having such functions. A mono-bath bleach-fixing solution is an example thereo Also, each step may be conducted, if desired or necessary, by separating it into two or more substeps, or a processing of a combination such as color development—first fixing—bleach fixing may be conducted. Additionally, the development processing steps can involve, if desired or necessary, a prehardening bath, a neutralizing bath, a first development (black-and-white development), an image-stabilizing bath, washing, and like steps in addition to the above described steps. The processing temperature is set within a preferred range depending upon the light-sensitive material and the processing formulations, and a temperature of 18° C. or above is often employed, though temperatures of less than 18° C. are used in some cases. Temperatures of 20° C. to 60° C., recently particularly 30° to 60° C., are often employed. Additionally, it is not generally necessary to set the temperature of a series of processing steps at the same level, though such may be favorable for continuous processing.

The color developer is desirably an alkaline aqueous solution of a pH of about 8 or above, preferably 9 to 12, containing a developing agent, an oxidation product of which reacts with a coupler to form a colored compound. The developing agent is a compound having a primary amino group on an aromatic ring which is capable of developing exposed silver halide, or a precursor capable of forming such a compound. As the developing agent, there can be illustrated 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methanesulfoamidoethylaniline, 4-amino-N,N-dimethylaniline, 4-amino-3-methoxy-N,N-diethylaniline, 4-amino-3-methyl-N-ethyl-N-β-methoxyethylaniline, 4-amino-3-methoxy-N-ethyl-N-β-methoxyethylaniline, 4-amino-3-β-methanesulfoamidoethyl-N,N-diethylaniline, and the salts thereof (e.g., sulfate, chloride, sulfite, p-toluenesulfonate, etc.) as preferred typical examples. In addition, there are those described in U.S. Pat. Nos. 2,193,015 and 2,592,364; Japanese Patent Application (OPI) 64,933/73; L. F. A. Mason, *Photographic Processing Chemistry*, pp. 226–229, Focal Press, London (1966). Also, the above described compunds may be used in combination with 3-pyrazolidones. To the color developer there may be added, if desired or necessary, various additives.

Typical examples thereof include alkali agents (e.g., hydroxides, carbonates or phosphates of alkali metals or ammonium), pH adjusting or buffering agents (e.g., weak acids such as acetic acid, boric acid, etc., weak bases and salts thereof), development accelerators (e.g., various pyridinium compounds as described in U.S. Pat. Nos. 2,648,604; 3,671,247; etc., cationic compounds, potassium nitrate, sodium nitrate, polyethylene glycol condensates as described in U.S. Pat. Nos. 2,533,990; 2,577,127; 2,950,970; etc., and derivative thereof, nonionic compounds such as polythioethers represented by the compounds as described in British Pat. Nos. 1,020,033 and 1,020,032; polymer compounds having a sulfite ester group represented by the compounds as described in U.S. Pat. No. 3,068,097; organic amines such as pyridine, ethanolamine, etc., benzyl alcohol, hydrazines, and the like), an anti-fogging agent (e.g., alkali bromide, alkali iodide, nitrobenzimidazoles as described in U.S. Pat. Nos. 2,496,940 and 2,656,271; mercaptobenzimidazole, 5-methylbenzotriazole, 1-phenyl-5-mercaptotetrazole, compounds for rapid processing as described in U.S. Pat. Nos. 3,113,864; 3,342,596; 3,295,976; 3,615,522; 3,597,199; etc., thiosulfonyl compounds as described in British Pat. No. 972,211, phenazine-N-oxide compounds as described in Japanese Patent Publication No. 41,675/71; anti-fogging agents as described in *Kagaku Shasnin Binran* (*Scientific Photographic Handbook*), II, pp. 29–47, etc.), stain or sludge preventing agents as described in U.S. Pat. Nos. 3,161,513 and 3,161,514; in British Pat. Nos. 1,030,442; 1,144,481 and 1,251,558; an interimage effect accelerating agent as described in U.S. Pat. No. 3,536,487; and a preservative (e.g., sulfite, bisulfite, hydroxylamine hydrochloride, a formaldehyde-sulfite adduct, an alkanolamine-sulfite adduct, etc.).

The light-sensitive material of the present invention is subjected to a bleaching in a conventional manner after color development processing. This processing may be conducted simultaneously with or separately from the fixing.

To this bleaching solution there may be added, if desired or necessary, a fixing agent to use it as a bleach-fixing bath. As the bleaching agent, many compounds can be used. Of these, ferricyanic acid salts, dichromate, water soluble cobalt (III) salts, water soluble copper (II) salts, water soluble quinones, nitrosophenols, a complex salt between a multivalent metal cation such as iron (III), cobalt (III), copper (II), etc., and an organic acid, in particular, complex salts between these multivalent metal cations and organic acids (e.g., a metal complex salt of ethylenediaminetetraacetic acid, nitrilotriacetic acid, iminodiacetic acid, N-hydroxyethylethylenediaminetriacetic acid or a like aminopolycarboxylic acid, malonic acid, tartaric acid, malic acid, diglycolic acid, dithioglycolic acid; 2,6-dipicolinic acid-copper complex salt; etc.), peracids (e.g., alkylperacid, persulfate, permanganate, hydrogen peroxide, etc.), hypochlorites, chlorine, bromine, bleaching powder, and the like are generally used alone or in a suitable combination.

To this processing solution may further be added various additives including bleach accelerating agents as described in U.S. Pat. Nos. 3,042,520 and 3,241,966, in Japanese Patent Publications Nos. 8,506/70, 8,836/70, etc.

Having thus generally described the invention, the following examples illustrate currently preferred modes of practicing the invention. Unless otherwise indicated, all percentages are by weight.

EXAMPLE 1

20 g of coupler (Y-1) having the following formula:

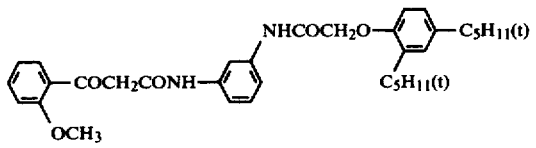

was dissolved in 20 g of di-n-butyl phthalate and 40 g of ethyl acetate at 65° C. This coupler solution was added to 250 g of a 10% gelatin aqueous solution (heated to 50° C.) containing 1.0 g of a fluorine containing anionic surface active agent of the present invention, Monflor 31 (sodium perfluoroaliphatic hydrocarbon sulfonate having 10 carbon atoms, trade name of Imperial Chemical Industries Ltd.) while stirring, followed by stirring for 20 minutes using a high speed homogenizer to obtain Emulsion A. The mean particle size of this emulsion was 0.10μ. Emulsion B, prepared in the same manner as described above except for using sodium dodecylbenzenesulfonate (showing good emulsifying ability among hydrocarbon surface active agents) for the purpose of comparison, had a mean particle size of 0.22μ. Thus, it is seen that Emulsion A in accordance with the present invention had a finer particle size.

These two emulsions were cool-set and stored at 5° C. to examine the stability thereof in cooled state with the passage of time. The particle size of Emulsions A and B after storage was measured. The results thus obtained are shown in Table 1. From Table 1, it can be seen that the particle size in comparative Emulsion B increased with the passage of time, whereas Emulsion A in accordance with the present invention did not undergo a great change in particle size even after storage for 30 days under cooling. Thus, excellent stability of the emulsion of the present invention was demonstrated.

TABLE 1

| Emulsion | Mean Particle Size (micron) Immediately after Preparation | After 15 Days | After 30 Days |
|---|---|---|---|
| A (present invention) | 0.10 | 0.10 | 0.13 |
| B (comparison) | 0.22 | 0.29 | 0.38 |

Each of these two Emulsions A and B was added to 500 g of a blue-sensitive original emulsion containing 0.18 mol of silver bromoiodide and 50 g of gelatin.

Each of the resulting two emulsions was coated on a cellulose triacetate film base as a first layer, and cooled to set the same. Then, a 30° C. aqueous solution containing 0.25 g of saponin and 20 g of gelatin per 100 ml was coated thereon as a second layer. After drying, the resulting samples were cut into two 4×4 cm pieces, respectively, and subjected to air conditioning for 2 days under the conditions of 40° C., 90% RH (RH: relative humidity) while avoiding contacting the pieces with each other. Then, two pieces of the same kind were brought into contact with each other with the protective layers facing each other, and stored for 1 day under the conditions of 40° C., 90% RH while applying a load of 800 g. Then, the film pieces were delaminated to calculate the area (%) of the adhered portions. The results are shown in Table 2. Results of measuring the kinetic friction coefficient between protective layers are given in Table 3, and cloud values determined after developing, fixing and washing unexposed samples are given in Table 4.

TABLE 2

| Sample | Adhered Area (%) |
|---|---|
| Using Emulsion A | 65 |
| Using Emulsion B | 96 |

TABLE 3

| Sample | Kinetic Friction Coefficient* |
|---|---|
| Using Emulsion A | 0.23 |
| Using Emulsion B | 0.25 |

*A smaller kinetic coefficient shows better sliding property.

TABLE 4

| Sample | Cloud Value* |
|---|---|
| Using Emulsion A | 23 |
| Using Emulsion B | 33 |

*Determined using an integrating sphere type haze meter, SEP-H-SS, made by Nihon Seimitsu Kogaku Co. Smaller cloud values show better transparency.

From these results, it is seen that the coated and dried sample using Emulsion A of the present invention was excellent in adhesion resistance and transparency as compared with comparative Emulsion B.

EXAMPLE 2

40 g of coupler (C-1) having the following formula:

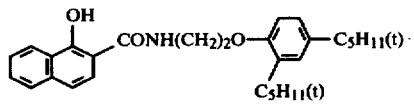

was dissolved in 40 g of di-n-butyl phthalate and 80 g of ethyl acetate at 65° C. This coupler solution was added to a 50° C. mixture consisting of 2 g of a fluorine containing anionic surface active agent (A-1) of the present invention, $$CF_3(CF_2)_7SO_2\underset{\underset{C_3H_7}{|}}{N}CH_2CH_2CH_2SO_3Na,$$

and 100 g of a 10% gelatin aqueous solution while stirring, then passed 5 times through a colloid mill to obtain coupler Emulsion C. The mean particle size of Emulsion C was 0.08μ. The mean particle size of Emulsion D, prepared in the same manner as described above except for using the sodium salt of dioctylsulfosuccinate as an emulsifier, was 0.15μ. After removing ethyl acetate from Emulsions C and D using a rotary evaporator, the stability thereof with the passage of time in the cooled state was examined. The results thus obtained are shown in Table 5. From the results, the excellent stability of the emulsion in accordance with the present invention can be seen.

TABLE 5

| | Mean Particle Size (μ) | | |
|---|---|---|---|
| Emulsion | Immediately after Preparation | After 15 Days | After 30 Days |
| C (present invention) | 0.08 | 0.08 | 0.09 |
| D (comparison) | 0.15 | 0.18 | 0.23 |

EXAMPLE 3

20 g of coupler (M-1) having the following formula:

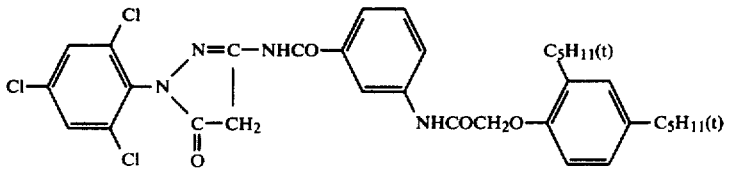

was dissolved in 30 g of tricresyl phosphate and 40 g of ethyl acetate at 65° C. This coupler solution was added to a 50° C. mixture consisting of 100 g of a 10% gelatin aqueous solution and 10 g of a 5% aqueous solution of a fluorine containing anionic surface active agent (A-7) of the structural formula:

$$CF_3(CF_2)_7SO_2\underset{\underset{C_3H_7}{|}}{N}CH_2CH_2O(CH_2CH_2O)_3(CH_2)_3SO_3Na$$

used in the present invention, while stirring, then passed 5 times through a colloid mill to prepare Coupler Emulsion E. The mean particle size of Emulsion E was 0.18μ. The mean particle size of Emulsion F, prepared in the same manner as described above except for using sodium triisopropylnaphthalenesulfonate, was 0.34μ.

Emulsions E and F were stored in a heated molten state (40° C.) while stirring to examine the stability of the emulsions. The results are shown in Table 7. Thus, it was demonstrated that the emulsion containing the emulsifier of the present invention showed excellent stability when stored for 24 hours under heated conditions, while the comparative emulsion suffered from an increase in particle size with the passage of time.

100 g of each of these two Emulsions E and F was added to 360 g of a red-sensitive original emulsion containing 0.11 mol of silver bromide and 18 g of gelatin.

Each of these resulting emulsions was coated on a cellulose triacetate film base as a first layer, and cooled to set. Then, a 30° C. aqueous solution containing 0.25 g of saponin and 20 g of gelatin per 100 ml was coated thereon as a second layer. The resulting samples were cut into two 4×4 cm pieces, respectively, and subjected to air conditioning for 2 days under the conditions of 40° C., 90% RH while avoiding contacting the pieces with each other. Then, two pieces of the same kind were brought into contact with each other with the protective layer facing the base, and stored for 2 days under the conditions of 40° C., 90% RH while applying a load of 1 kg. The results of calculating the area (%) of the adhered portions upon delamination are shown in Table 6.

TABLE 6

| Sample | Adhered Area |
|---|---|
| Using Emulsion E | 73 |
| Using Emulsion F | 94 |

The above described results show that the coated and dried sample using Emulsion E of the present invention was excellent in adhesion resistance as compared with that using Emulsion F for comparison.

TABLE 7

| | Mean Particle Size (micron) | | |
|---|---|---|---|
| Emulsion | Immediately after Preparation | After 12 Hours | After 24 Hours |
| E (present invention) | 0.18 | 0.18 | 0.18 |
| F (comparison) | 0.34 | 0.42 | 0.60 |

EXAMPLE 4

10 g of the ultraviolet ray absorbing agent (U-5) having the following formula:

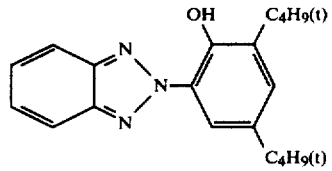

was dissolved in 20 g of di-n-butyl phthalate and 15 g of ethyl acetate at about 65° C. This solution of the ultraviolet ray absorbing agent was added to 100 g of a 10% gelatin aqueous solution (50° C.) containing 0.4 g of the fluorine containing anionic surface active agent (A-12) of the present invention having the formula:

$CH_2COOCH_2(CF_2)_6H$
|
$CHCOOCH_2(CF_2)_6H$
|
$SO_2Na$ while stirring, then stirred for 5 minutes using a high speed mixer (6,000 rpm) to obtain an ultraviolet ray absorbing agent Emulsion G. The mean particle size of this emulsion was 0.08μ. The mean particle size of Emulsion H of the ultraviolet ray absorbing agent, prepared in the same manner as described above except for using sodium dodecylbenzenesulfonate as an emulsifier, was 0.25μ. Thus, it is seen that Emulsion G of the present invention had a finer particle size.

EXAMPLE 5

5 g of the ultraviolet ray absorbing agent (U-7) having the following formula:

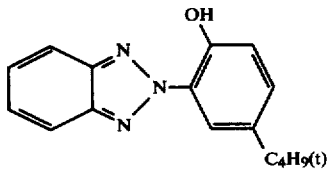

was dissolved in 20 g of tricresyl phosphate and 10 g of butyl acetate at 65° C. This solution of ultraviolet ray absorbing agent was added to an aqueous solution consisting of 100 g of a 10% gelatin aqueous solution and 10 g of a 10% aqueous solution of the fluorine containing surface active agent (A-17) of the present invention having the following formula:

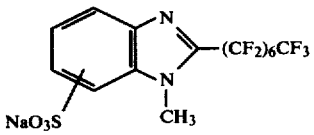

while stirring, then emulsified for 15 minutes using a high speed mixer to prepare Emulsion I of the ultraviolet ray absorbing agent. The mean particle size of this emulsion was 0.10μ. In the same manner as described above except for using sodium dioctylsulfosuccinate as an emulsifier, there was prepared Emulsion J. The mean particle size of Emulsion J was 0.30μ.

Emulsions I and J were cooled to set, and the same stored at 5° C. to examine the stability thereof with the passage of time under cooling. The change in mean particle size of each emulsion with the passage of time was as shown in Table 9. Thus, it is seen that Emulsion I in accordance with the present invention possessed good stability with the passage of time under cooling.

The total amount of each of these two Emulsions I and J was added to 540 g of a green-sensitive original emulsion containing 0.22 mol of silver bromoiodide and 45 g of gelatin, and coated and dried in the same manner as in Example 1 to prepare samples. The results of adhesion tests on these samples are shown in Table 8.

TABLE 8

| Sample | Adhered Area |
|---|---|
| Using Emulsion I | 68 |

TABLE 8-continued

| Sample | Adhered Area |
|---|---|
| Using Emulsion J | 93 |

From these results, it is seen that the coated and dried sample using Emulsion I of the present invention was excellent in adhesion resistance as compared with that using Emulsion J for comparison.

TABLE 9

| | Mean Particle Size (micron) | | |
|---|---|---|---|
| Emulsion | Immediately after Preparation | After 15 Days | After 30 Days |
| I (present invention) | 0.10 | 0.10 | 0.15 |
| J (comparison) | 0.30 | 0.35 | 0.52 |

EXAMPLE 6

5 g of an antioxidant, 2,5-di-tert-octylhydroquinone, was dissolved in 10 g of di-n-butyl phthalate and 15 g of ethyl acetate at 65° C. This solution was added to a 50° C. mixture consisting of 100 g of a 10% gelatin aqueous solution and 10 g of a 5% aqueous solution of the fluorine containing surface active agent (A-26) having the following formula:

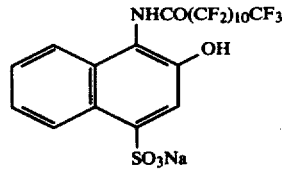

of the present invention, while stirring, then emulsified for 15 minutes using a high speed mixer to prepare Emulsion K of the antioxidant. The mean particle size of this emulsion was 0.13μ. The mean particle size of Emulsion L, prepared in the same manner as described above except for using sodium dodecylbenzenesulfonate as an emulsifier, was 0.42μ. In this case, too, it is seen that Emulsion K in accordance with the present invention possessed a finer particle size.

EXAMPLE 7

20 g of the coupler (Y-1) having the following formula:

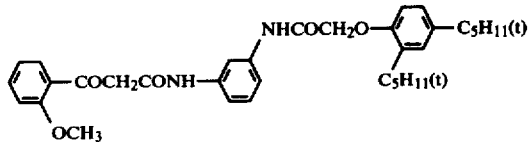

was dissolved in 20 g of di-n-butyl phthalate and 40 g of ethyl acetate at 65° C. This coupler solution was added to 200 g of a 10% gelatin aqueous solution (heated to 50° C.) containing 0.2 g or 0.5 g of the fluorine containing anionic surface active agent (A-1) of the formula:

$CF_3(CF_2)_7SO_2NCH_2CH_2CH_2SO_3Na$
|
$C_3H_7$ used in the present invention, while stirring, then stirred for 20 minutes using a high speed homogenizer to prepare Emulsions M and N, respectively. In the same manner as described in Example 1 except for using 1 g of sodium dodecylbenzenesulfonate, there was prepared emulsion 0 for the purpose of comparison. The results of measuring the mean particle size of these emulsions are shown in Table 10.

TABLE 10

| Emulsion | Mean Particle Size (micron) |
|---|---|
| M (present invention) | 0.22 |
| N (present invention) | 0.20 |
| O (comparison) | 0.21 |

As is seen from the results, Emulsions M and N showed about the same mean particle sizes as that of comparative Emulsion O in spite of the fact that the amounts of emulsifier was 1/5 and ½, respectively, that of Emulsion O.

While the invention has been described in detail and with reference to specific embodiments thereof, it will be apparent to one skilled in the art that various changes and modifications can be made therein without departing from the spirit and scope thereof.

What is claimed is:

1. In a process for preparing a color photographic material wherein a coating solution comprising at least one oil soluble photographic additive emulsified and dispersed into a hydrophilic colloid aqueous solution is coated as a layer of said photographic material, said oil soluble additive being selected from the group consisting of oil soluble couplers, DIR coupling compounds forming no color, ultraviolet ray absorbing agents, fading preventing agents, color mixing preventing agents, stain preventing agents and antioxidants, the improvement which comprises preparing said coating solution by adding said at least one oil soluble photographic additive in a liquid state and an anionic surfactant to said hydrophilic colloid aqueous solution and agitating said mixture sufficiently by applying a high shearing force or high strength ultrasonic wave energy to said mixture to emulsify and disperse said at least one oil soluble photographic additive into said hydrophilic colloid aqueous solution as stable particles of less than 0.5 micron in particle size, said anionic surfactant being represented by the formula:

$$(R_f)_n(B)_m—X \quad (I)$$

wherein $R_f$ represents a fluorine substituted alkyl or alkenyl group having 4 to 18 carbon atoms, wherein X represents an $—SO_3M$ or $—OSO_3M$ group (M being a hydrogen atom or a cation), said surfactant containing 1 to 3 $—SO_3M$ or $—OSO_3M$ groups, wherein B represents (I) a di- or trivalent organic residue having 1 to 30 carbon atoms, or (2) a multivalent group wherein a di- or trivalent organic residue having 1 to 30 carbon atoms is combined with a divalent linkage group selected from the group consisting of —CO—O—, —O—CO—, —N-R—CO—, —CO—NR— and $—SO_2NR—$ wherein R represents a hydrogen atom or an alkyl group having 1 to 18 carbon atoms, wherein n represents 1 or 2, and wherein m represents 0 or 1.

2. The process of claim 1, wherein $R_f$ represents a fluorinated hydrocarbon having 8 or more fluorine atoms and containing a terminal carbon atom substituted with 2 or 3 fluorine atoms.

3. The process of claim 1, wherein $R_f$ represents a moiety selected from the group consisting of 1,1,7-trihydrododecafluoroheptyl, 1,1,11-trihydroeicosalfluoroundecyl, perfluorooctyl, 1,1-dihydropentadecylfluorooctyl and perfluoro-3-ethyl-1,2,3-trimethyl-1-pentenyl.

4. The process of claim 1 wherein the oil soluble photographic additive is melted to be in the liquid state.

5. The process of claim 1 wherein the oil soluble photographic additive is dissolved in an organic solvent to be in the liquid state.

6. The process of claim 1, wherein from about 0.5 to about 50% by weight based on the dispersion weight, of said surface active agent is used.

7. The process of claim 1 wherein said di- or trivalent residue is selected from the group consisting of an aliphatic hydrocarbon group, an arylene group and a divalent heterocyclic group.

* * * * *